US006027100A

United States Patent [19]

Dubé et al.

[11] Patent Number: 6,027,100

[45] Date of Patent: Feb. 22, 2000

[54] APPARATUS FOR SUPPORTING MODULAR FURNITURE

[76] Inventors: Jean-Guy Dubé , 1415 Beaver Pond Drive, Gloucester, Ontario, Canada, K1V 3X5; Kamal Roy Nandram, 1520 Orchard Avenue, Ottawa, Ontario, Canada, K1H 1A8

[21] Appl. No.: 09/066,693

[22] Filed: Apr. 27, 1998

Related U.S. Application Data

[63] Continuation-in-part of application No. 09/034,267, Mar. 4, 1998.

[51] Int. Cl.[7] ..... B66F 7/12

[52] U.S. Cl. ..... 254/89 R; 254/329; 254/114

[58] Field of Search ..... 254/329, 369, 254/266, 89 R

[56] References Cited

U.S. PATENT DOCUMENTS

| | | | |
|---|---|---|---|
| 1,952,238 | 3/1934 | Dice | 254/329 |
| 2,072,398 | 3/1937 | Faulk | 254/329 |
| 5,261,643 | 11/1993 | Wurdack | 254/106 |
| 5,299,779 | 4/1994 | Collins | 254/1 |
| 5,385,335 | 1/1995 | Wurdack | 254/1 |
| 5,490,757 | 2/1996 | Stratman | 414/680 |
| 5,529,287 | 6/1996 | Pelosi, Jr. et al. | 254/129 |
| 5,628,610 | 5/1997 | Stratman et al. | 414/680 |

*Primary Examiner*—Timothy V. Eley
*Assistant Examiner*—Benjamin M. Halpern
*Attorney, Agent, or Firm*—Jones, Tullar & Cooper, PC

[57] ABSTRACT

Apparatus for supporting modular furniture including panels to allow access to a floor for reflooring or the like, and suitable for supporting a panel end while providing a clear space under said panel end. The apparatus has a bridge member capable of spanning a distance of several feet and end supports engageable with outer end portions of the bridge member for supporting it clear of the floor. A carrier slidably mounted on the bridge member between its end portions has a support which is connectable to a lifting jig engaged with the panel end. A tensioning or jacking device is provided for applying force to the support so that the panel end may be supported while allowing access to a floor area between said end supports.

21 Claims, 13 Drawing Sheets

APPARATUS FOR SUPPORTING MODULAR FURNITURE

This application is a continuation in-part of copending U.S. application Ser. No. 09/034,267, filed Mar. 4, 1998.

BACKGROUND OF THE INVENTION

1. Field of the Invention

The present invention relates to apparatus for supporting modular furniture of the type used in offices. The apparatus is used in association with lifting means to allow access to an office floor, e.g. for replacement of carpets or other flooring, including panels of raised flooring, without the need to remove the furniture from the office.

2. Prior Art

Modern offices are often provided with so-called "modular furniture", which comprises an arrangement of panels interconnected at angles to form office dividers, and which have so-called "hanging tracks" used to support desks, bookshelves, and other necessary office equipment. These hanging tracks are vertical metal strips, usually located near the edges of the panels, having a series of undercut slots from which special hangers, with suitable hooks, can be suspended. Generally, these hanging tracks are aligned with feet which support the panels, and which usually provide the only contact between the floor and the modular furniture.

The fact that quite a number of such panels, and their associated desks and shelves, are connected together makes it time consuming and costly to dismantle this furniture and remove it from an office to allow carpeting or other flooring to be replaced. Accordingly, apparatus has been designed and used which will allow the panels and associated furniture to be temporarily raised so that new flooring can be placed underneath. Apparatus of this kind is described, for example, in:

U.S. Pat. No. 5,261,643, issued Nov. 16, 1993 to Wurdack;

U.S. Pat. No. 5,299,779, issued Apr. 5, 1994 to Collins;

U.S. Pat. No. 5,385,335, issued Jan. 31, 1995 to Wurdack;

U.S. Pat. No. 5,490,757, issued Feb. 13, 1996 to Stratman;

U.S. Pat. No. 5,529,287, issued Jun. 25, 1996 to Pelosi, Jr. et al.; and

U.S. Pat. No. 5,628,610, issued May 13, 1997 to Stratman et al.

Several of these patents use lifting jigs which have plates with a series of hooks for engaging the hanging tracks of the panels; for example the Wurdack patents, and those of Stratman and Pelosi et al. have this feature. Another lifting device, and one which has more stability than the prior devices, is described in Applicant's co-pending Canadian Patent Application No. 2,223,736, filed Feb. 18, 1998. This lifts the panels by engaging their undersides, near to the legs, and thus avoids applying upwards force to the hanging tracks, since in some makes of panel such forces may cause the hanging tracks to be dislocated.

Another shortcoming of the previously patented arrangements is that it is difficult or impossible to place carpeting underneath the leg of a panel, since this is usually where the lifting device is positioned. Some installers simply accommodate the panel leg and/or the lifting device by cutting out a portion of the carpet or carpet tile, or slitting this around the leg. In our co-pending Canadian patent application aforesaid, a bridge member is provided having feet which can be placed at either side of a leg, and the bridge member carries a saddle member with auxiliary jacking means which can be used to lift the leg portion of a panel while leaving a clear space under the leg area where reflooring can be done. This bridge is good for spanning a space 3 feet or possibly 4 feet wide, and is suitable particularly where the flooring is supplied in the form of carpet tiles.

However, if it is desired to install strips of carpeting supplied in rolls, there is often a need for providing a clear space under aligned panels of more than 4 feet width, and sometimes more than 6 feet width, which requires a larger bridge than in the system described in our copending application. Another limitation of this system is that in many cases the low or "floor level" bridge described in our copending application would meet interference from other panels connected at right angles to the panels being lifted by the bridge system. The present invention provides a system which includes both a provision for a greater width of clear space, suitable in the preferred form for installation of a 6 foot wide carpet strip, and also provides a system in which bridge members used to support the lifting means can be high enough not to interfere with connected panels.

SUMMARY OF THE INVENTION

In accordance with one aspect of the invention, apparatus for supporting modular furniture, including panels, to allow access to a floor for reflooring or the like, and in which the apparatus is suitable for supporting a panel end while providing a clear space under the panel end, comprises:

- a bridge member capable of spanning a distance of several feet;
- end supports including posts engageable with outer end portions of the bridge member for supporting the bridge member clear of the floor,
- a carrier slidable horizontally on said bridge member between its end portions;
- load carrying means held by the carrier for supporting a lifting jig rigidly engaged with the panel end, the load carrying means including means for applying upwards force to the lifting jig so that the panel end may be supported while allowing access to a floor area between the supports.

The reference to the "panel end" and similar references will be understood to mean the end portion of a panel, since the hanging tracks and legs are not strictly at the ends but are close to the ends of the panels.

The lifting jig may be substantially the same as that of my copending application, and is preferably such as to apply lifting force to the underside a panel end around or near to a panel leg, while an upper portion of the lifting jig is attached to a hanging track of the panel end.

The bridge member may be a high or overhead type, being above the tops of panels being supported. Alternatively, in suitable circumstances, a low or "floor level" bridge member may be used, of similar height to those shown in our aforesaid copending application.

In the case of an overhead or high bridge member, the load carrying means preferably includes a flexible webbing strap, and the force applying means may include a winding spool mounted on the carrier and holding the upper end of the strap, and having a handle and a ratchet and pawl arrangement which normally prevents unwinding. In the case of a low, floor level bridge member, the load carrying means preferably engages the underside of a lifting jig, and the force applying means may include auxiliary jacking means carried by the carrier.

For the overhead bridge member, each end support may include a post of sufficient length to hold the bridge member above tops of the panels; this allows the bridge member to extend over other panels which may be joined to the panel or panels engaged by the lifting jig. The posts may be supported from the floor, on opposite sides of a panel, in which case the posts preferably hold the bridge member at least 50 or 66 inches from the floor. Alternatively, support posts for the overhead bridge member may be mounted on hanger brackets which are supported by hanging tracks at the ends of two panels of an aligned pair of panels, the suspension means being connected between the bridge member and a lifting jig which supports the central adjoining ends of the two panels.

The invention further provides a method of lifting modular furniture including panels having accessory hanging tracks to allow access to a floor for reflooring or the like, comprising:

connecting a lifting jig to one hanging track of a panel end, and using jacking means and a floor mounted vertical shaft to raise the lifting jig along said shaft to lift the panel end;

positioning a bridge member adjacent to said one hanging track, the bridge member having end supports for supporting the bridge member above the floor, slidably positioning a carrier on said bridge member, said carrier having load carrying means, and using said load carrying means to support said lifting jig and thereby to support the panel end; and lifting or removing said shaft to provide access to a floor area under the bridge member and between said end supports.

BRIEF DESCRIPTION OF THE DRAWINGS

Preferred embodiments of the invention will now be described by way of example with reference to the accompanying drawings, in which.

DETAILED DESCRIPTION

Figure 1:
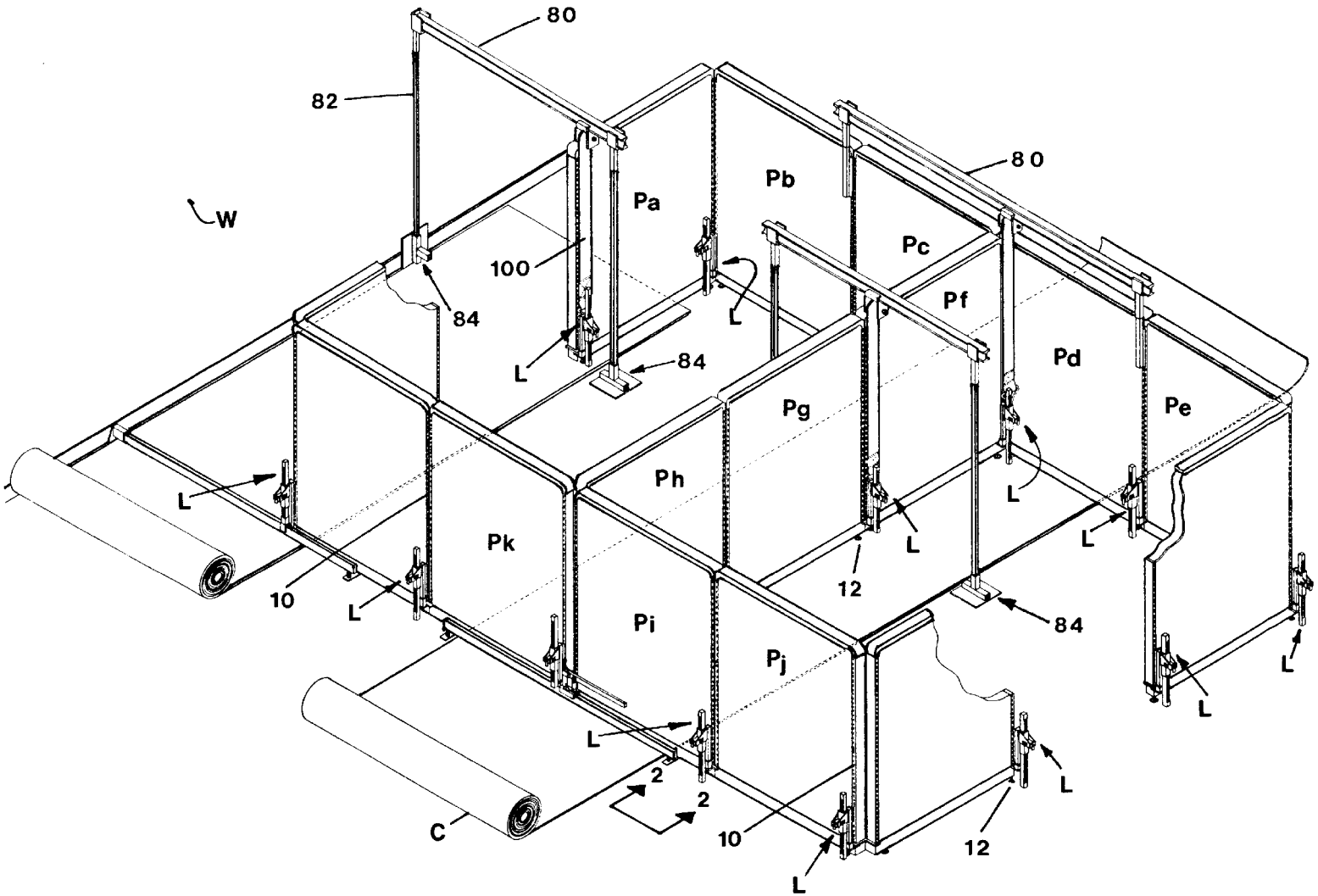
FIG. 1 is a perspective view of two office cubicles formed by panels of the type which normally support modular furniture, and show lifting means both in accordance with this invention and the invention described in our aforesaid copending application.

Referring to FIG. 1, this shows an arrangement of panels Pa, Pb, etc. forming two cubicle-type offices. The panels would normally have desks and other items of modular furniture attached to them, but such items are omitted for simplicity. Each panel has a hanging track 10 adjacent and parallel to an outer edge, each track having a series of elongated apertures, and each track is approximately aligned with a leg 12. In the arrangement shown in the drawing lifting devices L are positioned for lifting the ends of the panels, so that all panels can be lifted substantially simultaneously to avoid straining the panels.

FIG. 1 shows simple lifting means L which are initially used at the ends of almost all the panels, but some of these are partially replaced with bridge type apparatus in accordance with this invention depending on where a particular carpet strip C is to be laid. These simple lifting means L are the same as shown and described in our aforesaid copending application, but are described herein, and shown in detail in FIGS. 2 and 3, since the lifting jig parts of these lifting means are also used in the bridge type apparatus of the present invention.

Figure 2:
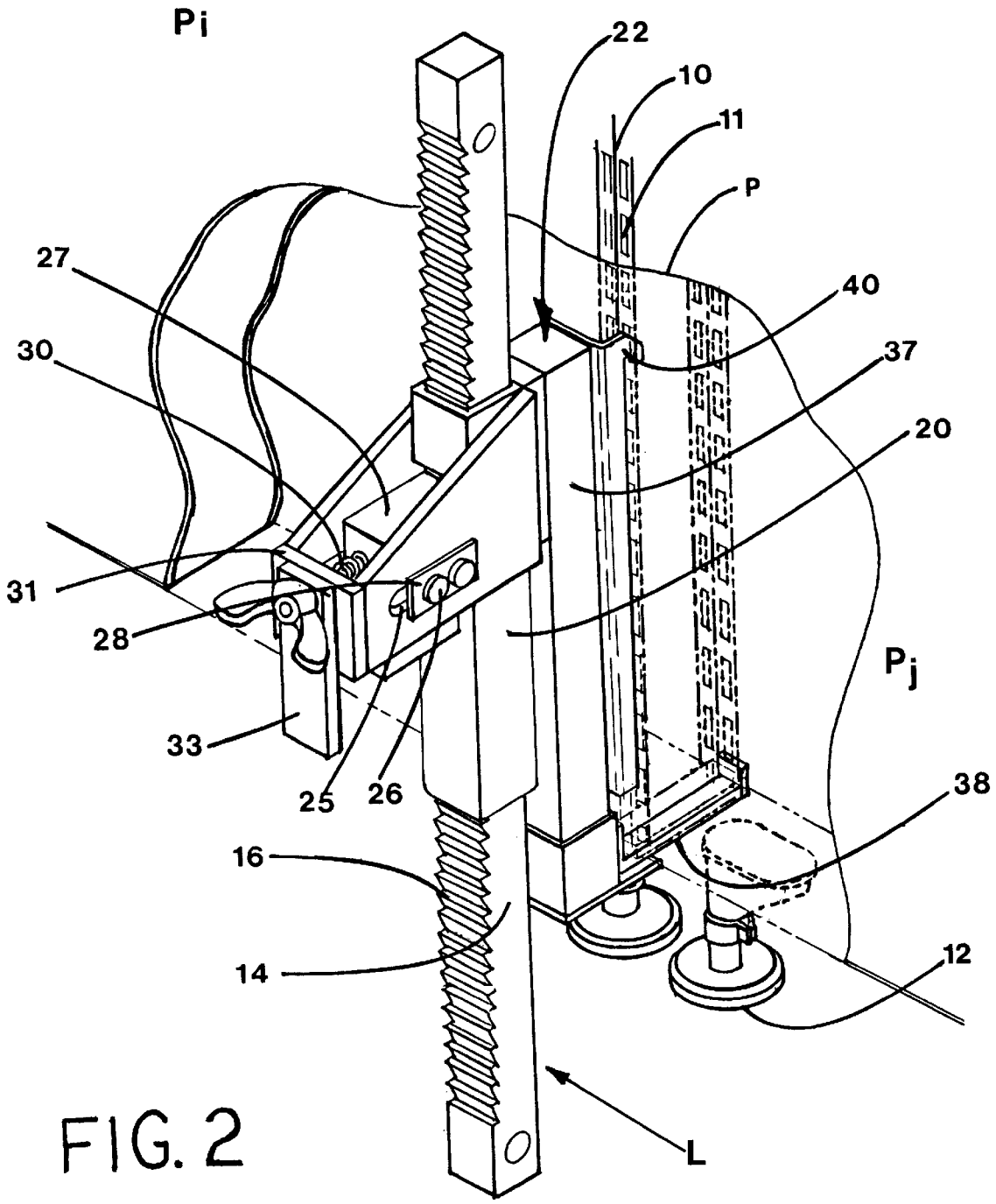
FIG. 2 is an elevational view on lines 2—2 of FIG. 1, showing the type of lifting apparatus of our copending application.
Figure 3:
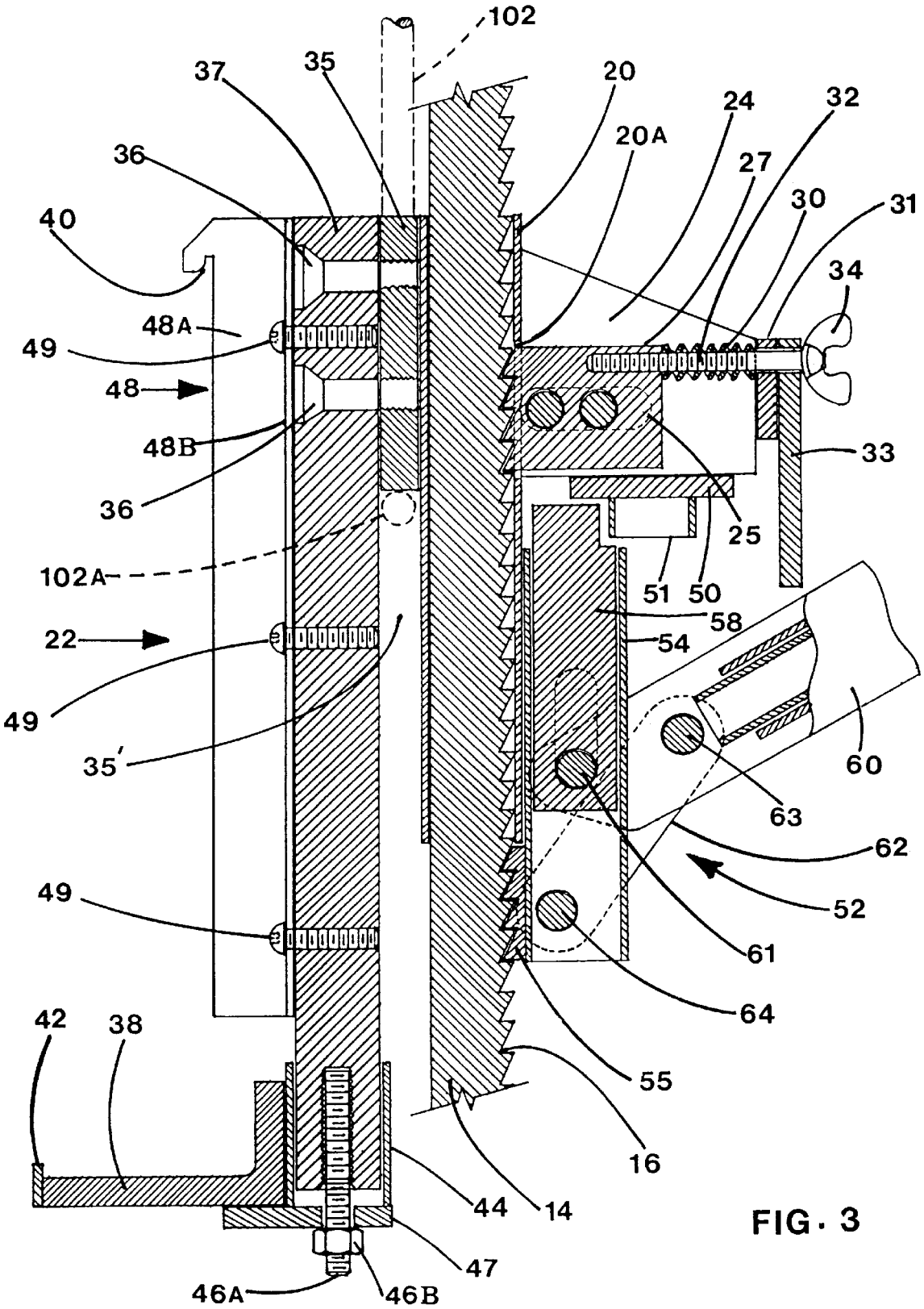
FIG. 3 is an enlarged sectional view of part of the lifting apparatus of FIG. 2.

As shown in FIGS. 2 and 3, each lifting means has a support including a shaft 14 which normally extends vertically, and which has a square section. The side of the shaft opposite the panel or panels, hereinafter referred to as the rear side, is provided with a rack 16 of ratchet type teeth having substantially horizontal upper surfaces. Slidable on the shaft 14 is a square-sectioned sleeve 20 which closely surrounds the shaft and which is part of a lifting jig indicated generally at 22. Walls 24 extending rearwardly from opposite sides of the sleeve 20 have horizontally elongated slots 25 which provide guides for the ends of a pair of slidable horizontal pins 26 which support a pawl 27 located between the walls 24. The outer ends of the pins 26 are connected together outside the walls 24 by spacer plates 28. The pawl 27 is movable within an aperture 20*a* in the rear of the sleeve 20, and has a series of teeth which, as best seen in FIG. 3, are complementary to those of the rack 16 and are caused to engage those teeth by the action of compression spring 30 acting between the rear of the pawl 27 and a back wall 31 joining the rear ends of the walls. The pawl 27 is movable to release the rack by a rod 32 threaded into the pawl and passing along the center of the spring 30 and through apertures in wall 31 in a pawl retracting lever 33, and which terminates in a pawl retracting wing screw 34. The lever 33 can be manually pivoted away from the wall 31 to pull the rod 32 so as to release the pawl from the rack 16.

Referring to FIG. 2, this shows the lifting jig 22 being used to lift and support the junction of the adjacent panels Pi and Pj, each having a hanging track 10 at its adjoining edges with a series of elongated apertures 11. FIG. 3 shows that the front side of the sleeve 20 carries a spacer mounting plate 35 to which is attached, by screws 36, a square sectioned main bracket support 37 which carries the panel engaging parts of the lifting jig 22. The spacer mounting plate 35 separates the sleeve 20 from the main bracket support 37 to provide a downwardly open recess 35' underneath the plate 35. The panel engaging parts include a boot support plate 38 and an undercut hook member 40. The plate 38 has an outer upturned retaining lip 42, and is carried by a boot sleeve 44 having an upwardly open recess fitting onto the lower end of the main bracket support 37. The boot sleeve is adjustably held in place by a screw stud 46*a* and nut 46*b*, the screw stud fitting into a threaded bore in the bottom end of support 37. A boot brace plate 47 underlies and reinforces the connection between the plate 38 and the boot sleeve 44. The hook 40 is formed in a projecting flange 48*a* of a plate member 48 which also has a right-angled flange 48*b* which lies against the front side of the support 37 and which has three laterally elongated slots which receive screws 49 attaching the plate member to the support 37. These slots allow adjustment of the lateral position of the hook 40 relative to the support plate 38. As shown, the undercut hook 40 provides a downwardly facing recess which is capable of engaging on the lower edge of a panel aperture 11, while the support plate 38 engages the lower edge of the same panel, as shown in FIG. 1. The nut 46*b* allows the plate 38 to be raised so that the panel is positively gripped between the hook recess and the plate, whereby the jig rigidly engages the panel end, i.e. without angular movement relative thereto.

As seen in FIG. 3, the lifting jig 22 also includes an abutment or support plate 50, held by the lower edges of the walls 24, from which projects a short cylindrical tube 51 which provides a jack piston retainer for the movable part or "piston" of removable jacking means 52, as shown in FIG. 3; it can also be used to locate the piston of a hydraulic jack. The jacking means has a lower, relatively fixed, piston casing 54 the sides of which are supported by a toothed pawl or gripper block 55 capable of engaging on the rack 16 below the sleeve 20. The piston casing slidably holds a piston 58 movable relative to the casing by a jack handle 60. The handle is connected to the lower end of the piston 58 by a cross pin 61 which is movable in vertically elongated slots in the sides of the casing, and the handle 60 also has connection to the casing provided by side links 62 which extend between a holding cross pin 63 near the handle lower end and a similar pin 64 fixed across the lower end of the casing and which also holds the gripper block 55 in the casing. With this arrangement, downwards movement of the handle 60 pushes up the piston 58 and thus raises the whole jig and panel part carried thereby by an amount equivalent to several teeth of the rack 16.

Figure 4:
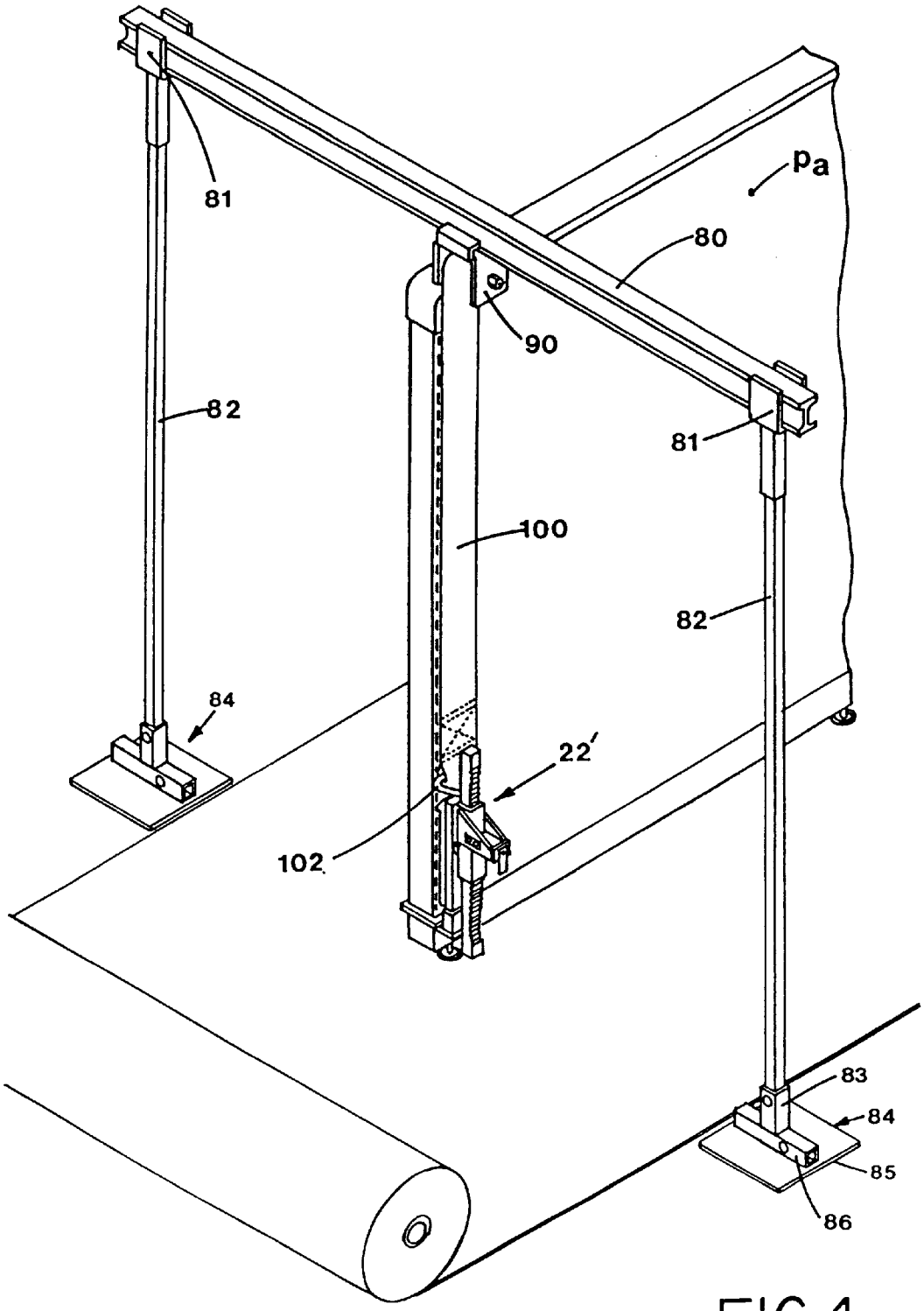
FIG. 4 is a perspective view of the overhead bridge type lifting apparatus in accordance with this invention.

Turning now to the bridge arrangement of this invention, and especially the overhead bridge arrangement, FIG. 4 shows a supporting bridge which can be used to support the end of panel Pa, and which is also used to support the junction of panels Pf and Pg, while providing a clear space under the panel end to allow reflooring. This arrangement includes a bridge member 80 in the form of an I beam of slightly more than 6 foot length, supported near to its ends by brackets 81 fixed to the upper ends of floor supported posts 82 formed of square steel tubing. The posts are high enough to hold the bridge above the tops of the panels which range in height from 36 to 96 inches. Typically, the posts are high enough to hold the member 80 at least 50 or 66 inches above floor level. The lower end of each post is received in a square-sectioned socket 83 which is part of base 84 and which protrudes perpendicularly from a flat steel plate 85. These parts provide a removable base for the post 82 with a measure of stability. It is a feature of the base 84 that it has a secondary socket 86 with its side welded parallel to the plate 85. This can be used as an alternative to the socket 82 where it is required to place a post very close to a wall, as will be described with reference to FIG. 6.

Figure 5:
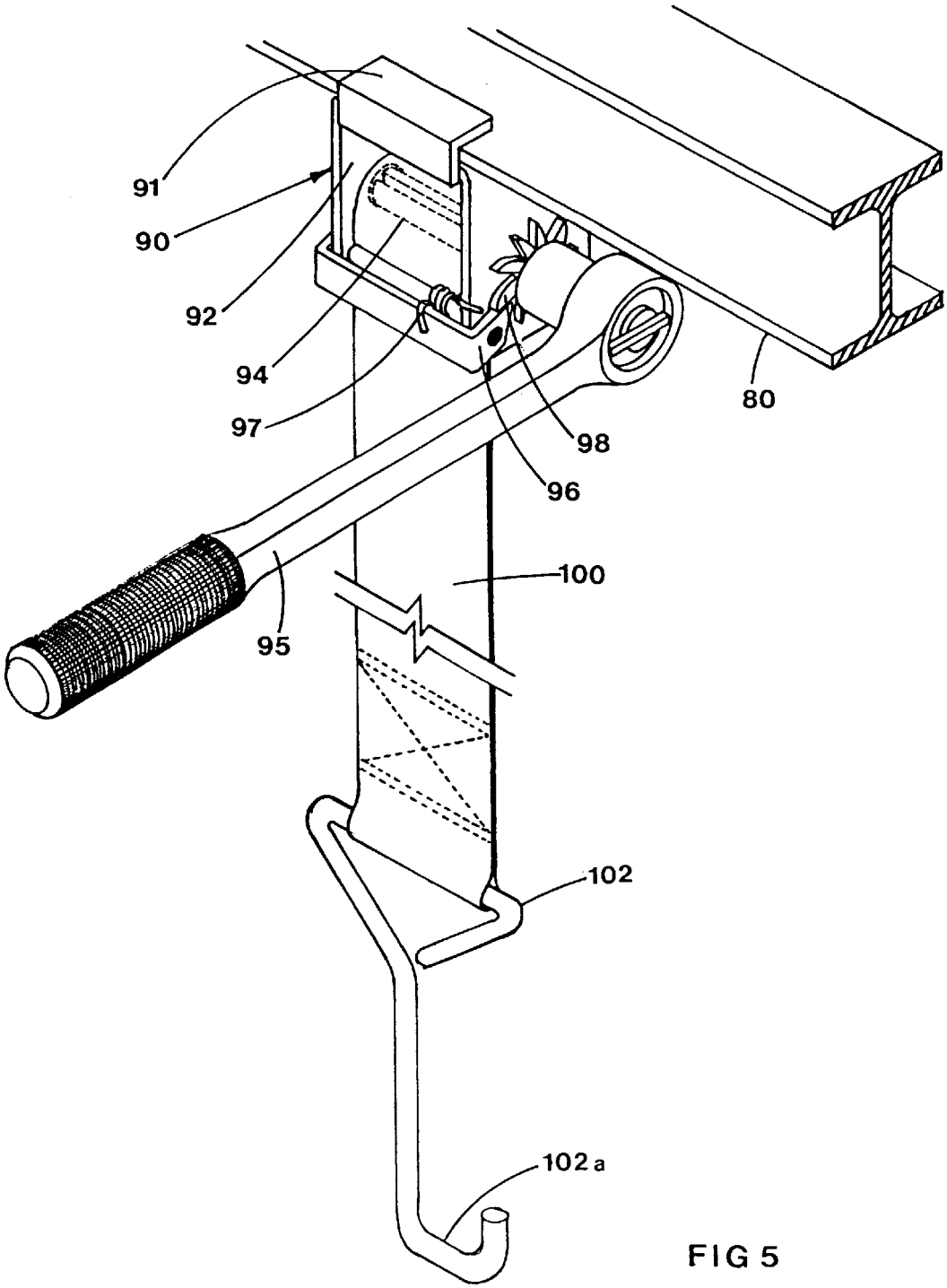
FIG. 5 is an enlarged view of a part of the apparatus of FIG. 4.

As shown in more detail in FIG. 5, the lower flange of bridge member 80 supports a carrier 90, slidable along the bridge member for adjustment of its position, and having inturned flanges 91 which engage the bridge member 80, and side plates 92 which between them support a winding spool formed by a slotted portion of a shaft 94 having an outer end suitably shaped for receiving a handle 95. The plates 92 also support a pawl 96 held by spring 97 against a ratchet wheel 98 fixed to the shaft 94. The winding spool holds a webbing strap 100, which surrounds and conceals it in FIG. 5. This arrangement allows the webbing strap to be wound onto the winding spool by operation of the handle 95, while the pawl 96 prevents unwinding until manually disengaged.

The lower end of the strap 100 is secured to the top of a connector 102 formed of bent steel rod which has a hook-like lower end 102*a* which fits into the recess 35' under the spacer mounting plate 35 of a lifting jig 22', similar to that shown in FIG. 3, and which provides load carrying means to support the panel end after the shaft 14 has been raised or removed. The position which the hook-like lower end 102*a* would occupy in relation to the lifting jig is illustrated in broken lines in FIG. 3. The winding spool, ratchet and handle arrangement provides tensioning means for the strap 100; this is similar to tensioning devices used to tighten webbing straps around truck loads. The winding spool provides enough rotation to allow the length of the suspended strap to be adjusted to different lifting jig heights. In addition, it allows the strap to be wound in by an amount required to transfer load from a shaft 14 supporting the lifting device L to the bridge member, for which a movement of 0.5 to 1.0 inches is sufficient. In the position shown in FIG. 4, the load has been transferred to the bridge member and the shaft 14 has been lifted to allow positioning of a carpet strip.

It may be noted that while the bridge 80 and other parts are only required to support the end of one panel Pa in the arrangement shown in FIG. 4, nevertheless these parts will more commonly be used to support the attached ends of two panels, as shown in relation to panels Pf and Pg, or three panel ends where a third panel is connected to the junction of the two panels, as for example at the junction of panels Pc, Pd, and Pf in FIG. 1. On occasion the bridge member may be used to support four panel ends at a point where four panels are connected together. Each panel with attached desks may weigh several hundred pounds, and in practice the bridge member should be able to support, at its center, a weight of 1,500 pounds, and preferably of at least 2,500 pounds.

It may also be noted that it is not essential that a strap forms the suspension means, and that this could be a metal rod. A strap is preferred, however, since it cannot scratch furniture.

Figure 6:
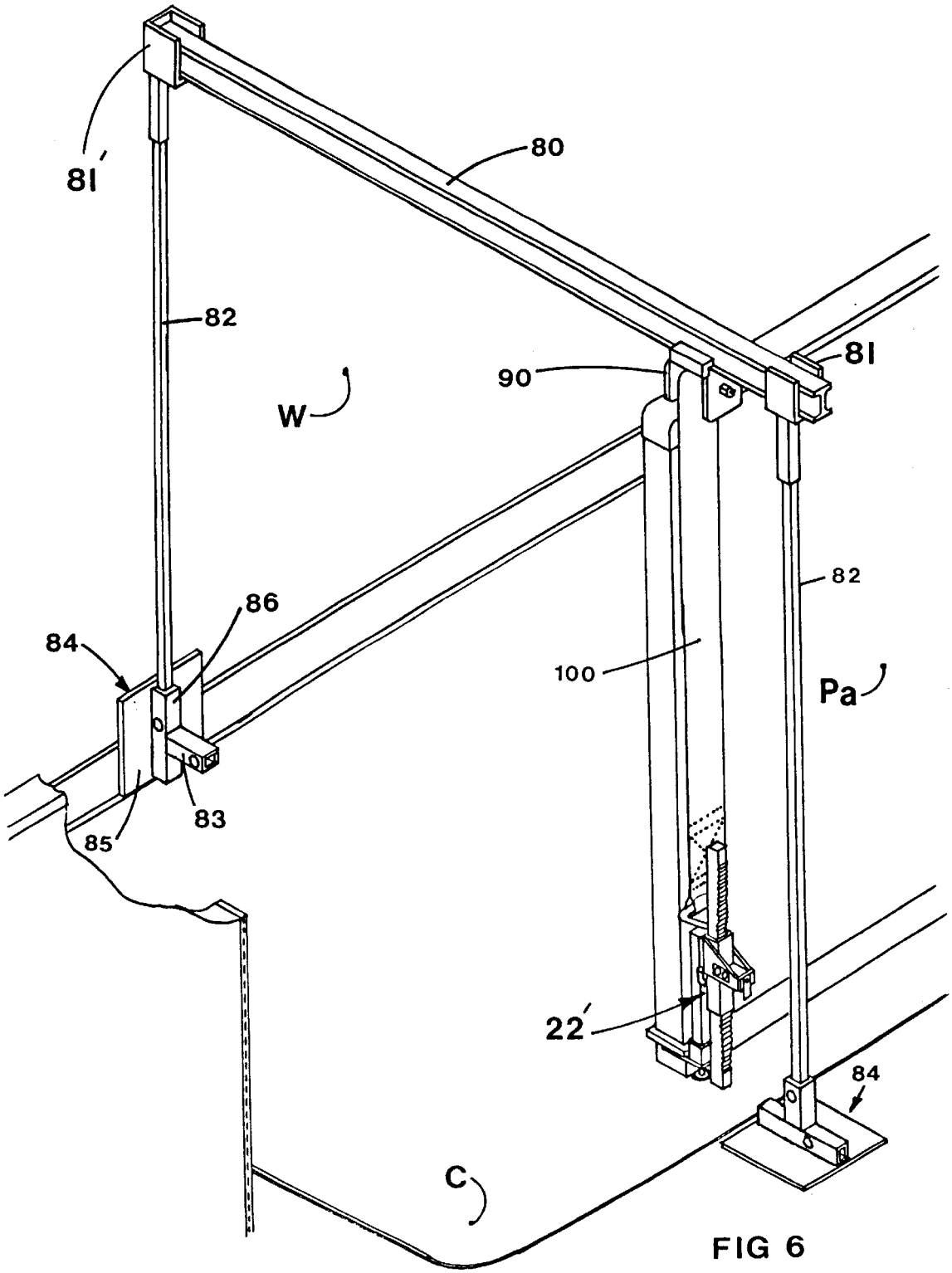
FIG. 6 is a view of apparatus similar to that of FIG. 4 being used in a different way.

FIG. 6 shows the same apparatus of FIGS. 4 and 5 being used in a different way, where it is required to place a 6 foot wide carpet strip C against a wall W and also under the end of panel Pa of FIG. 1. Here the base 84 is used with its plate 85 vertical and parallel and close to the wall, with the post 82 inserted into the secondary socket 86. Also, the top bracket 81 of the post is replaced at the wall end by a modified bracket 81' which has a closed end to prevent contact between the bridge member and the wall. The carrier 90 is also of course moved to a different position on bridge member 80.

Figure 7:
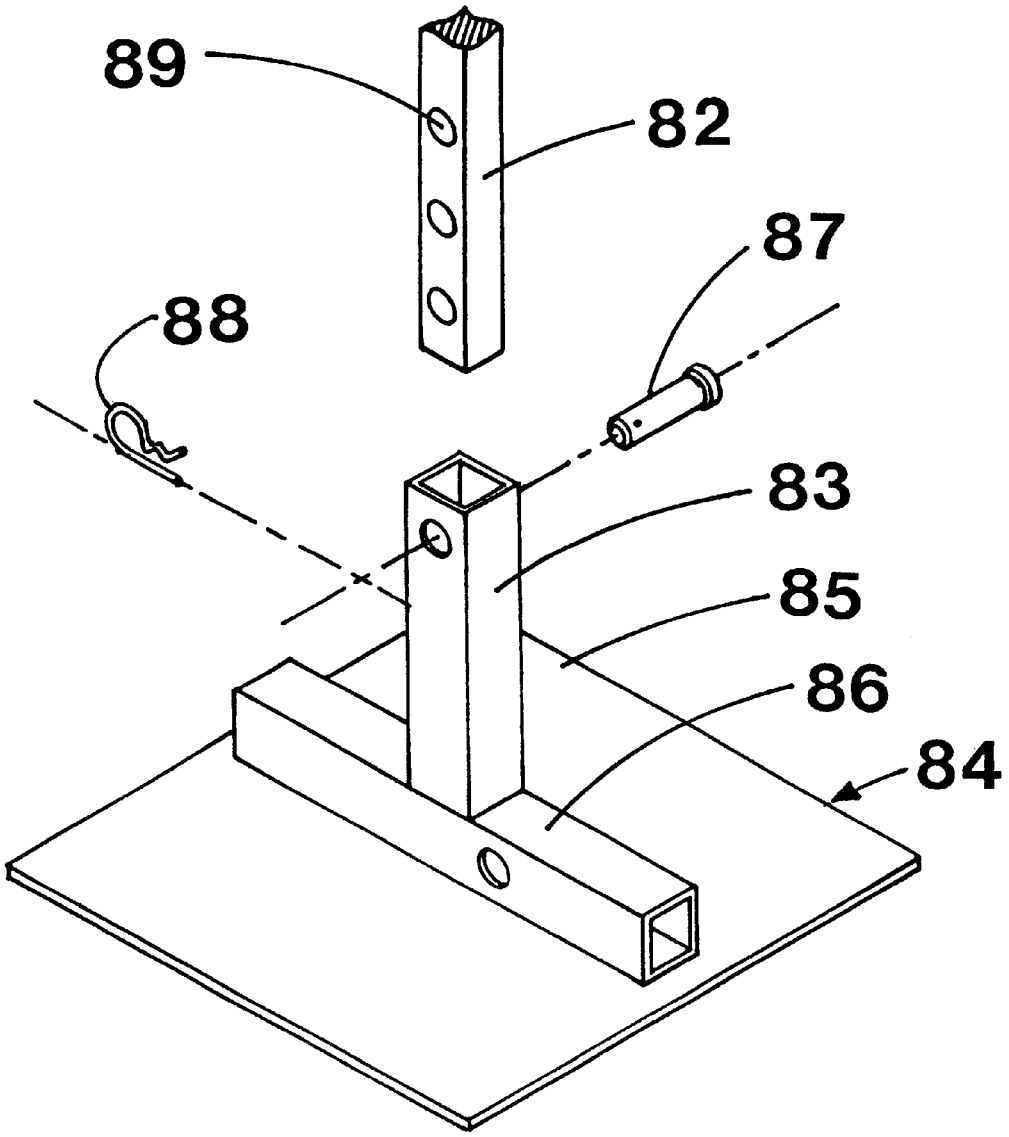
FIG. 7 is a detailed view of a base part for the apparatus shown in FIGS. 4 and 6.

FIG. 7 shows further details of the base 84. The secondary socket 86 is welded along the length of the plate 85 and has a closed end, and the socket 83, while still projecting perpendicularly relative to the plate, has its lower end welded to the center of the socket 86. The sockets of this base 84 are provided with transverse apertures for a cross pin 87, which can be retained by cotter pin 88, and which passes through transverse bores 89 in the lower end of each post 82.

Figure 8:
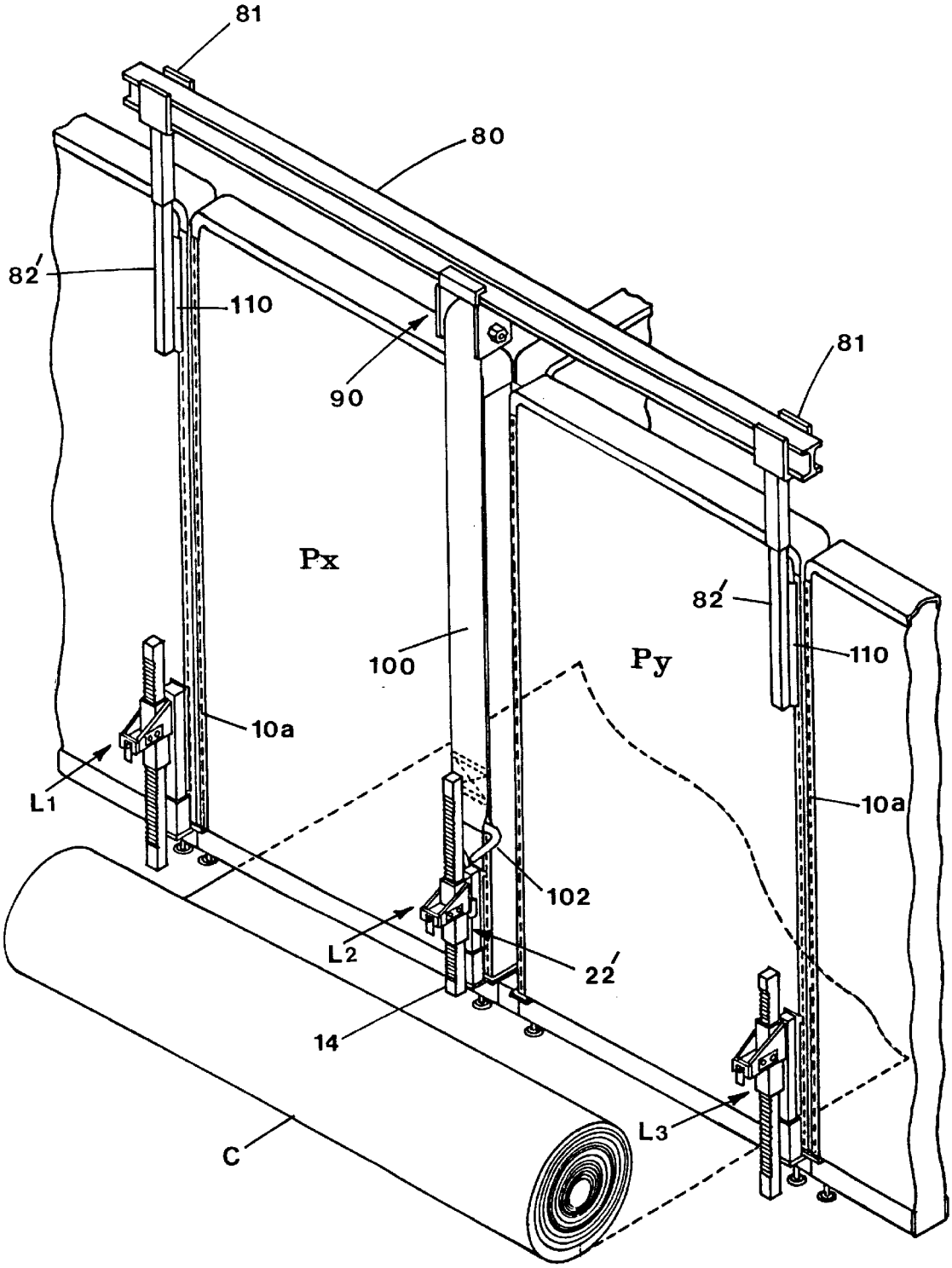
FIG. 8 is a perspective view of another arrangement of lifting means in accordance with this invention being used to lift two aligned panels.

FIG. 8 shows a variation of the apparatus of this invention which can be used when it is desired to lift two aligned panels in such a way that flooring can be fitted under the legs of the adjoining panel ends. Here, the outer ends of the two panels Px and Py, and the adjoining ends of the two panels, are initially lifted by the simple lifting devices L1, L2, L3 identical to the lifting means L shown in FIGS. 2 and 3, and it is required to fit carpeting under lifting device L2.

Figure 9:
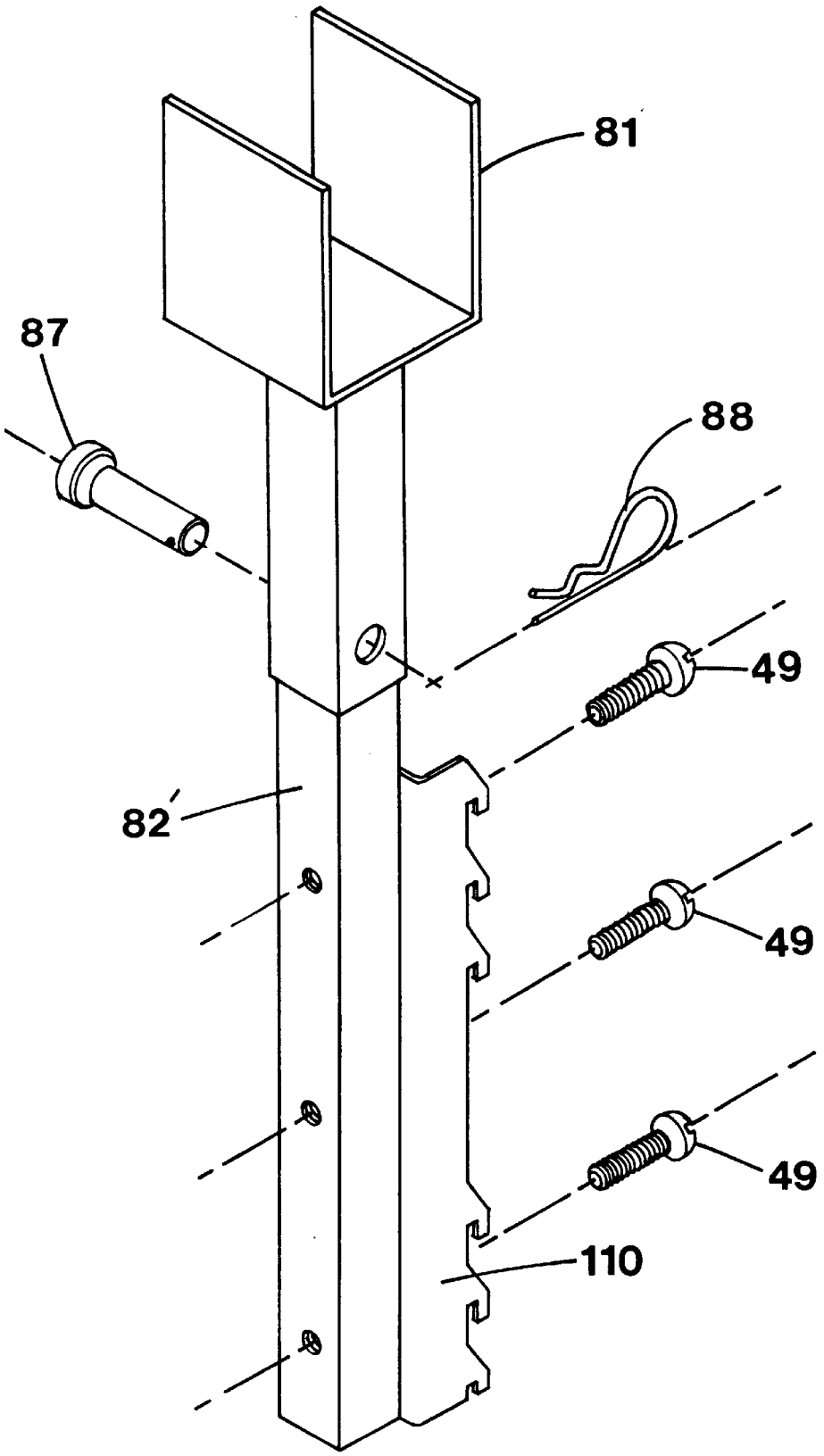
FIG. 9 is a view of a part of the apparatus shown in FIG. 8.

This apparatus does not require posts which extend between the floor and the bridge member as previously described; instead short posts 82' are each part of an assembly which includes a hanging bracket 110 held onto the post by screws 49, shown in FIG. 9. Each bracket 110 has a series of hooks which engage an outer end hanging track 10*a*. The upper end of each post carries a bracket 81 identical to the bracket 81 of the previous embodiment. The two brackets between them support a horizontal bridge member 80 identical to that of the previous embodiment, the posts 82' being of sufficient length that the member 80 is held wholly above the tops of the panels. A suitable length for the posts 82' is at least 20 inches. This allows the system to be used where there is another panel which might interfere, as for example when the system is being used to lift the junctions of panels Pc, Pd, and Pf in FIG. 1. In this embodiment, the lifting means L1 and L3 are aligned with the spines at the outer ends of the panels and these spines transmit the lifting forces from the lifting means L1 and L3 to the posts 82' and thus to the bridge member.

As in the previous embodiment the bridge member 80 supports a carrier 90 which holds a spool for a strap 100 the lower end of which has a hook like element 102 which fits under part 35 of the central lifting jig 22'.

In operation, the lifting means L1, L2 and L3 are firstly attached to the panel ends as shown, with a portion of each hanging track 10*a* being firmly held between the plates 38 and the hook portions 40 as described above. Similar devices are situated all around a number of connected panels, and all the panels and the attached fittings are lifted substantially evenly. For reflooring, it is usually sufficient to lift the panels only 1 or 1½ inches.

When it has been determined that a carpet strip needs to be positioned under the adjoining ends of the panels, the hangers 110 are then engaged in the upper portions of the outer hanging tracks 10*a*, and the bridge member 80 is located in the brackets at the tops of the posts 82', with the carrier 90 located centrally of the bridge member. The hook element 102 is then used to suspend the central lifting jig, the strap 100 being tensioned by handle 95 so that the weight of the adjoining panels ends is transferred to the bridge member. The shaft 14 of the central lifting means L2 can then be lifted or removed, and a roll of carpeting C, typically 6 foot in width, can be inserted under a row of the panels, for example as illustrated in FIG. 1.

Depending on the load to be lifted, it may be possible to use the apparatus of FIG. 8 without first lifting with the lifting devices L2, L3 and L4. Instead, the hanger and post assemblies, and the bridge member, may be put into place before any lifting occurs, and the central lifting jig may then be suspended by the strap 100, suitable tension being applied by handle 95. The shaft 14 of lifting device 14 is not required in this option. The pair of panels may then be lifted together by operation of the lifting devices L1 and L3, with the strap and bridge arrangement lifting the adjoining panel ends.

Figure 10:
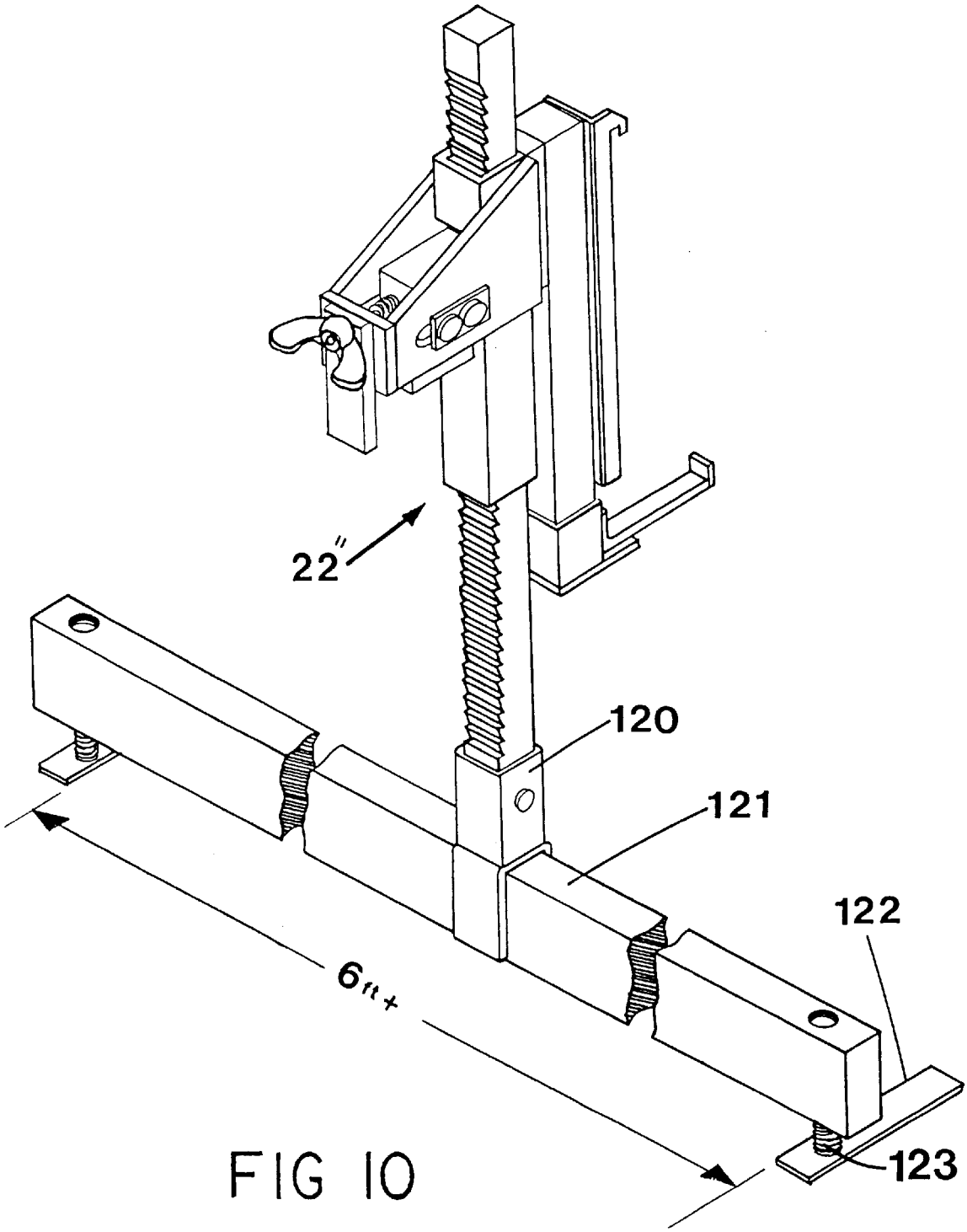
FIG. 10 is a perspective view of another form of lifting apparatus in accordance with this invention.

FIG. 10 shows a floor level bridge apparatus closely similar to that described in our copending application suitable for lifting the adjoining ends of two panels while providing free space under the panel ends. This includes a lifting jig 22", identical to jig 22 described above, but which is mounted by means of a saddle 120 on a central portion of a bridge member 121 which engages the floor by means of two spaced feet 122 supporting threaded posts 123. Here the bridge is longer than the similar apparatus described in my copending application, being dimensioned so that the feet 122 are spaced more than 6 feet apart.

Figure 11:
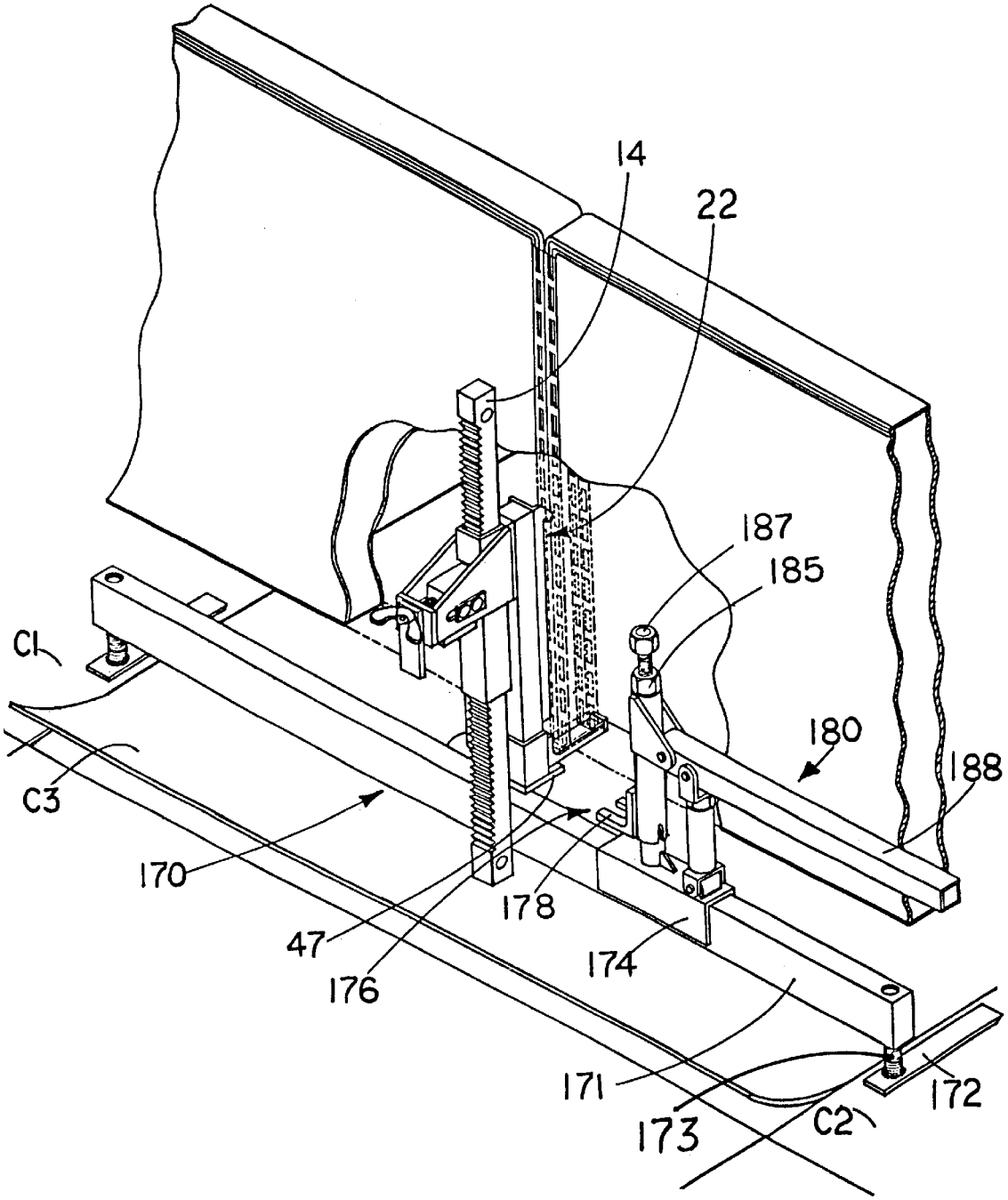
FIG. 11 is a perspective view of a yet another embodiment of the invention.
Figure 12:
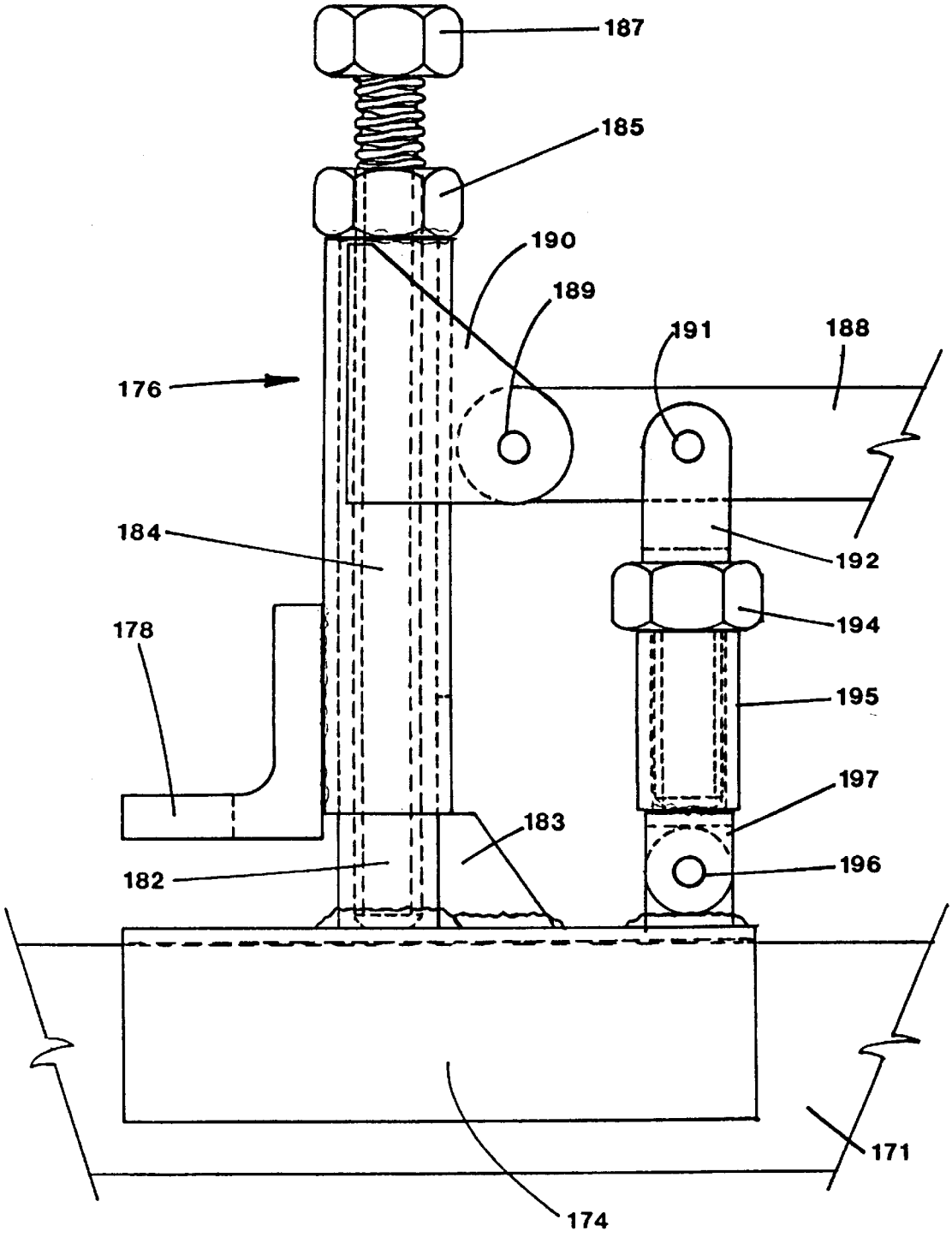
FIG. 12 is a detailed view of part of the apparatus shown in FIG. 11.
Figure 13:
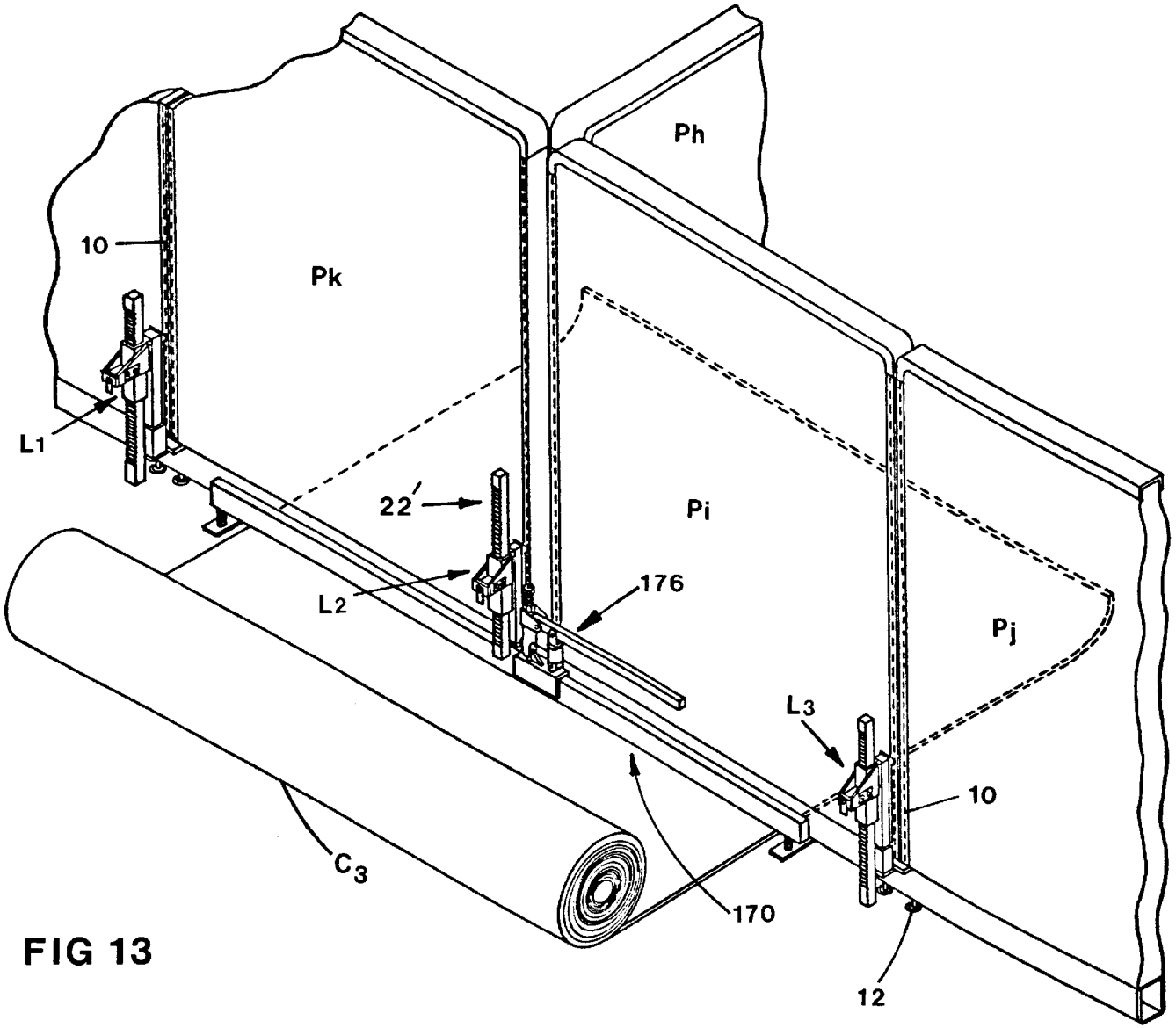
FIG. 13 is a view of the apparatus of FIG. 11 when the load carrying means is fully in position.

FIGS. 11–13 show a further version of a floor level bridge arrangement, which operates more like the embodiments of FIGS. 4–8 in that it may be used to support adjoining panel ends which have previously been lifted by simple lifting means indicated in FIG. 13 at L2, and which include a vertical shaft 14 and a lifting jig movable vertically on the shaft by jacking means described above with reference to FIG. 3. This apparatus may be used where carpet strips such as $C_1$, $C_2$, shown in FIG. 11, have been laid in the vicinity of a lifting device, and where it is desired to replace a strip $C_3$ in the position occupied by the lifting device L2.

As shown, the additional apparatus includes a bridge assembly 170 having a bridge member 171 which comprises a straight length of rectangular tubing or solid bar stock supported by spaced apart feet 172 and posts 173 which are adjustable in height and hold the bridge member 171 several inches above the floor. The bridge member 171 is preferably long enough that the feet 172 can be spaced far enough apart to provide a clear working space of more than 6 feet between the legs. On this bridge member is slidable a carrier 174 of saddle form, i.e. with depending sides which contact the sides of the bridge and hold it upright, and which carries an auxiliary load carrying means 176. The load carrying means 176 includes a load angle bracket 178 which can fit under the boot brace plate 47 to support the lifting jig 22, and also includes auxiliary jacking means 180 for raising this bracket.

The auxiliary jacking means 180, best seen in FIG. 12, includes a tubular sleeve post 182 braced by a gusset 183 to the carrier 174, on which post is slidable an actuator cylinder 184 which carries the load angle bracket 178, and which has nut 185 welded to its upper end. This nut receives a height adjustment screw 187 which extends down through the sleeve post to engage the carrier at its lower end. The cylinder 184, along with screw 187, can be raised by a lever 188 which has its inner end pivoted at 189 to lever holding plates 190 welded to the sides of the actuator cylinder, and which has a fulcrum provided by a pivot pin 191 held by the top of a pivot bracket 192. The lower end portion of the bracket 192 is screw threaded and engages an adjustment nut 194 held by a pivot sleeve 195 which receives the main threaded part of the bracket 192, and which is connected to the carrier 174 by pivot pin 196 and fixed pivot bracket 197.

In operation, the bridge member is positioned as shown with its legs clear of the carpet strip $C_3$ which is to be replaced. The carrier 174 is moved from the position shown in FIG. 11 to that shown in FIG. 13 so as to be positioned with its bracket 178 under the boot brace plate 47, and the auxiliary jacking means is used to apply force to the boot brace plate so as to transfer the weight of the panel from the shaft 14 to the bridge member. This involves firstly raising the actuator cylinder 184 by rotation of the screw 187 until the bracket 178 is in contact with the boot brace plate, and then pushing down lever 188 to raise the bracket 178 until this is taking the full load of the panel. When the bridge is taking the full load, screw 187 is tightened so that its lower end again engages the bottom of the sleeve post 182 so as to hold the bracket 178 in position, after which the handle 188 is released. The shaft 14 can then be lifted or removed to allow replacement of the strip $C_3$.

We claim:

1. Apparatus for supporting modular furniture including panels to allow access to a floor for reflooring, said panels having hanging tracks adjacent their ends with each hanging track having a series of apertures, said apparatus being suitable for supporting a panel end while providing a clear space under said panel end, comprising:

a bridge member capable of spanning a distance of several feet;

end supports including posts engageable with outer end portions of said bridge member for supporting said bridge member clear of the floor;

a carrier slidably mounted on said bridge member between its end portions;

a lifting jig rigidly engageable with and capable of supporting said panel end, said lifting jig including undercut hook means engageable with an edge of an aperture of a said hanging track, load carrying means held by said carrier for carrying said lifting jig, the load carrying means including hook-like means capable of attachment to said lifting jig for applying upwards force to the lifting jig so that said panel end may be supported while allowing access to a floor area between said end supports.

2. Apparatus according to claim 1, wherein said lifting jig has a downwardly open recess, and wherein said load carrying means includes a flexible webbing strap and a winding spool holding an upper end of said strap and mounted on said carrier, said spool having a ratchet and pawl arrangement which normally prevents unwinding, and wherein said hook-like means is attached to said webbing strap and is suitable for fitting into said downwardly open recess to support the lifting jig.

3. Apparatus according to claim 1, wherein a said post is a floor-supported post with a bracket at its upper end for receiving an end portion of the bridge member, said post having a lower end provided with a base having a flat plate for contacting said floor.

4. Apparatus according to claim 3, wherein said post holds the bridge member at least 50 inches above a floor.

5. Apparatus according to claim 3, wherein said post holds the bridge member at least 66 inches above a floor.

6. Apparatus for supporting modular furniture including panels to allow access to a floor for reflooring, said apparatus being suitable for supporting a panel end while providing a clear space under said panel end, comprising:

a bridge member capable of spanning a distance of several feet;

end supports engageable with outer end portions of said bridge member for supporting said bridge member clear of the floor;

a carrier slidably mounted on said bridge member between its end portions;

load carrying means held by said carrier for carrying a lifting jig, the load carrying means including means for applying upwards force to the lifting jig so that said panel end may be supported while allowing access to a floor area between said end supports;

wherein a said end support is a floor-supported post with a bracket at its upper end for receiving an end portion of the bridge member;

and wherein the said end support includes a base member for said post having a flat plate, a first socket fixed to the plate and projecting perpendicularly from the plane of the plate and suitable for receiving an end portion of a post when the plate is placed flat on the floor, and a second socket fixed parallel to the plate so as to receive a post when the plate is placed vertically against or close to a wall.

7. Apparatus according to claim 6, wherein the second socket has its side welded to the plate.

8. Apparatus according to claim 1, wherein said panels have accessory hanging tracks at ends thereof, and wherein a said end support includes hanger means for engaging the hanger tracks at an outer end of a pair of aligned panels, and a post carried by said hanger means.

9. Apparatus for lifting and/or supporting modular furniture to allow access to a floor for reflooring, the furniture including aligned panels having accessory hanging tracks, said apparatus being suitable for lifting and/or supporting a pair of adjacent aligned panels, comprising:

two outer, spaced apart, floor supported lifting means for engaging and lifting the outer end of each panel of said pair, hanger means for engaging the hanging tracks at said outer ends of said panels;

end supports carried by said hanger means, a bridge member having end portions carried by said end supports and which spans the overall width of said pair of panels;

a carrier mounted centrally on said bridge member;

suspension means connected to said carrier and connected to a central lifting jig capable of supporting adjoining ends of said pair of panels;

means for applying tension to said suspension means so that the adjoining ends of the panels may be supported when their outer ends are lifted by said outer lifting means, whereby said adjoining ends of said panels may be held clear of the floor and allow clear access to a floor area between said outer lifting means.

10. Apparatus according to claim 9, wherein each said support means includes a post suitable for holding the bridge member above tops of panels engaged by the hanger means.

11. Apparatus according to claim 10, wherein each said post is at least 20 inches in height.

12. Apparatus according to claim 9, wherein said suspension means is a flexible webbing strap, and wherein one end of said strap is held by a winding spool having a handle, and also having a ratchet and pawl arrangement which normally prevents unwinding.

13. Apparatus according to claim 1, wherein said end supports are feet attached to the bridge member, and wherein said means for applying upwards force includes jacking means carried by the carrier and engageable with said lifting jig.

14. Apparatus for lifting or supporting modular furniture to allow access to a floor for reflooring, the furniture including panels having accessory hanging tracks, the apparatus including a support having a shaft which normally extends vertically, and a lifting jig which engages a panel in the region of its hanging track and which is movable vertically on the shaft by jacking means, and further comprising:

a normally horizontal bridge member extending between spaced end supports, and a carrier slidable horizontally on said bridge member and carrying the lower end of said shaft, whereby the support allows the shaft to occupy a wide variation of horizontally displaced positions above a clear working space under the bridge member and between said feet.

15. Apparatus for lifting or supporting modular furniture to allow access to a floor for reflooring, the furniture including panels having accessory hanging tracks, the apparatus including a support having a shaft which normally extends vertically and a lifting jig which engages a panel end in the region of its hanging track and which is movable vertically on the shaft by jacking means, and further comprising:

a normally horizontal bridge member extending between spaced end supports, and a carrier slidable horizontally on said bridge member and carrying auxiliary load carrying means for said lifting jig including means for applying upwards force to said auxiliary load carrying means, whereby when the support has lifted the panel end by movement of the lifting jig on the shaft, the bridge member and carrier and auxiliary load carrying means may be positioned and used to support the lifting jig, while the shaft is lifted or removed to provide clear working space under the bridge member and between said end supports.

16. Apparatus according to claim 15, wherein the means for applying force includes jacking means for raising said auxiliary load carrying means, and also includes an adjustment screw for holding the auxiliary support means in a position into which it is raised by said auxiliary jacking means.

17. Apparatus according to claim 1, wherein with the bridge member supported at its ends, the center of the bridge member can support at least 1,500 pounds weight.

18. Apparatus for lifting or supporting modular furniture to allow access to a floor for reflooring, said apparatus being suitable for lifting a panel end while providing a clear space under said end, comprising:

a bridge member capable of spanning several feet;

end supports engageable with outer end portions of said bridge member for supporting said bridge member clear above the tops of said panels;

wherein the end supports include a pair of spaced posts and one or more bases each having a flat plate, a first socket projecting perpendicularly relative to the plate and suitable for receiving an end portion of one of said posts when the plate is placed flat on a floor, and a second socket fixed parallel to the plate so as to receive a vertical post when the plate is placed vertically against or close to a wall.

19. Apparatus according to claim 1, wherein a said end support is a post with a bracket at its upper end for receiving an end portion of the bridge member.

20. Apparatus according to claim 19, wherein said postholds the bridge member at least 50 inches above a floor.

21. Apparatus according to claim 19, wherein said post holds the bridge member at least 66 inches above a floor.

* * * * *